US005704136A

United States Patent [19]

Cho

[11] Patent Number: 5,704,136

[45] Date of Patent: Jan. 6, 1998

[54] DRYING OPERATION ADJUSTING METHOD FOR WASHING MACHINE

[75] Inventor: In-Haeng Cho, Kyoungsangnam-do, Rep. of Korea

[73] Assignee: LG Electronics Inc., Seoul, Rep. of Korea

[21] Appl. No.: 771,828

[22] Filed: Dec. 23, 1996

[30] Foreign Application Priority Data

May 13, 1996 [KR] Rep. of Korea ..... 1996-15782

[51] Int. Cl.[6] ..... F26B 19/00

[52] U.S. Cl. ..... 34/562; 34/596; 68/12.04

[58] Field of Search ..... 34/318, 499, 58, 34/596, 524, 526, 527, 543, 550, 560, 562, 563, 564, 574; 68/12.02, 12.04, 12.12, 12.14

[56] References Cited

U.S. PATENT DOCUMENTS

| | | | |
|---|---|---|---|
| 4,481,786 | 11/1984 | Bashark | 62/160 |
| 4,853,605 | 8/1989 | Matsuo et al. | 318/729 |
| 4,862,710 | 9/1989 | Torita et al. | 68/12.04 |
| 5,156,025 | 10/1992 | Frucco | 68/12.02 |
| 5,402,586 | 4/1995 | Roh | 34/562 |
| 5,537,761 | 7/1996 | Oh | 34/499 |
| 5,606,877 | 3/1997 | Hashimoto | 68/12.04 |

FOREIGN PATENT DOCUMENTS

| | | | |
|---|---|---|---|
| 3035293-A | 2/1988 | Japan | 34/527 |
| 573703-A1 | 12/1993 | United Kingdom | 34/596 |

*Primary Examiner*—Henry A. Bennett
*Assistant Examiner*—Dinnatia Doster
*Attorney, Agent, or Firm*—Birch, Stewart, Kolasch & Birch, LLP

[57] ABSTRACT

A method of controlling the drying operation of a washing machine which comprising proceeding with an initial drying operation by applying a power voltage to a motor for a predetermined period of time according to the volume of laundry being treated; proceeding with an interim drying operation by applying a power voltage to the motor at a predetermined phase angle according to the volume of the laundry; and following with a main drying operation by applying a power voltage to the motor for a predetermined period of time.

4 Claims, 6 Drawing Sheets

| volume of laundry | controlling phase angle | motor-ON section |
|---|---|---|
| A | A' , A" | displaying section |
| B | B' , B" | displaying section |
| C | C' , C" | displaying section |

volume of laundry: A>B>C

DRYING OPERATION ADJUSTING METHOD FOR WASHING MACHINE

BACKGROUND OF THE INVENTION

1. Field of the Invention

The present invention relates to a method of controlling the drying operation of a washing machine, thereby reducing vibration generated in the beginning of an intermittent drying stroke of the washing machine.

2. Discussion of Related Art

FIG. 1 is a block diagram of a general washing machine. The washing machine includes a micro computer (MICOM) 10 for controlling the entire system to perform the necessary strokes of the washing machine; a switch operating part 11 for making a user selectively operate an operation panel for performing a desired stroke; a water level sensing part 12 for sensing the water level of the washing tub; a door sensing part 13 for sensing if the door of the washing machine is opened or closed; a load driving part 14 for controlling such elements as a cleaning motor, a detergent motor, a detergent valve, a drain valve, a drain motor, an automatic off, a cool water feeding valve and a warm water feeding valve; a content volume sensing part 15 for controlling the operation of the washing motor and calculating the pulse which is input to a predetermined terminal of the MICOM 10 for sensing the volume of the laundry and thus determining the water level of the washing tub; an oscillation part 16 for supplying a clock to the MICOM 10; a reset part for initializing the MICOM 10 when the power is turned on/off, thus stabilizing the operation of the MICOM 10; an interrupt part 18 for detecting a zerocross of the alternating current, that is, for determining the operating time of the MICOM 10 by recognizing, as a waveform, the point where the alternating power intersects with 0; and a power supply 19 for supplying power to the MICOM 10 and the peripheral circuit.

In the thus structured FIG. 1, the user recognizes the operation and the washing procedures of the washing machine through the switch operating part 11, and then operates the washing or drying only button to perform the desired operation or stroke.

When the switch operating part 11 performs the washing, rinsing or drying stroke, the water level sensing part 12 senses the water level of the washing tub. The door sensing part 13 senses if the door of the washing machine is opened or closed, and then outputs the result to the MICOM 10. Then MICOM 10 displays to the user the state where the door is opened during the washing stroke by initiating an alarm or a buzzer sound.

The load driving part 14 controls such elements as the cleaning motor, the detergent motor, the detergent valve, the drain valve, the drain motor, the automatic off, the cool water feeding valve, and the warm water feeding valve to perform the desired stroke. The content volume sensing part 15 controls the operation of the washing motor to thereby calculate the pulse input to a predetermined terminal so that it determines the water level of the washing tub by sensing the volume of the laundry by using the calculated pulse.

The oscillator 16 supplies a clock to the MICOM 10. The reset part 17 initializes the MICOM 10 in case the power is turned on/off to stabilize the operation of the MICOM 10. The interrupt part 18 detects a zerocross of the alternating current, that is, the part 18 determines the operating time of the MICOM 10 by recognizing, as a waveform, the point where the alternating power intersects with 0.

The power supply 19, which supplies power to the MICOM 10 and the peripheral circuit, also supplies power to the motor during the drying stroke to sequentially perform the beginning, intermittent and main drying strokes.

FIG. 2 is a flowchart illustrating a conventional drying control method made up of the following steps. First, it is determined if the stroke is for the drying stroke in step 201. Another stroke is performed if the stroke of S201 is not the drying stroke in step 202.

An initial drying time t1 is fixed according to the contents sensed by the content sensing part 15 if the stroke is the drying stroke in step 203. Then, the revolution per minute (RPM) of the motor, for example, A, B or C, is determined according to each drying section. Here, reference character A indicates the RPM of the motor for the initial drying operation. Reference character B indicates the RPM for the intermittent drying operation. Reference character C indicates the RPM for the main drying operation. RPMs A, B, and C are dependent upon the volume of the contents sensed by the content volume sensing part 15, and determined by test.

The motor is turned on to perform the initial drying operation in steps 204 and 205 until the RPM of the motor, as illustrated in FIG. 3, reaches A. Here, with a means for sensing the revolution speed of the motor, the power supplying part 19 applies power to the motor until the RPM of the motor reaches A. Without this means, the power supplying part 19 applies power to the motor only during the initial drying time t1 in order to perform the initial drying operation.

Additionally, the number of the intermittent drying operations is fixed by the initial drying time t1 when the RPM of the motor reaches A. That is, the number of turning on/off for the intermittent drying operation is fixed in relation to the content volume sensed by the content volume sensing part 15.

Therefore, when the RPM of the motor reaches A and thus the initial drying operation is completed, the motor is turned on until the RPM of the motor reaches B as in FIG. 3. Then, when the RPM of the motor reaches B, the intermittent drying operation, which turns off the motor, is performed in step 206. Here, when the RPM of the motor decreases because the motor is turned off for a predetermined time, the motor is turned on again until the RPM of the motor reaches B. When the RPM of the motor reaches B, the motor is turned off again. The above-mentioned operation is repeatedly performed as many times as predetermined for the initial drying time t1 in step 207.

When the intermittent drying operation is completed in the above step 207, the motor is kept ON without a break in step 208. Therefore, when the RPM of the motor reaches C as illustrated in FIG. 3, in step 209, power is continually applied to the motor to keep the motor's RPM at C, so that the main drying operation of the laundry is performed for a predetermined time in step 210.

However, the above-mentioned conventional method for controlling the drying operation generates a substantial amount of vibration and noise in the washing tub due to the motor of the washing machine being repeatedly turned on/off, and thus the life of the clutch is reduced because such repetition in turning the motor on/off significantly impacts the clutch.

SUMMARY OF THE INVENTION

Accordingly, the present invention is directed to a method of controlling the drying operation of a washing machine that substantially obviates one or more of the problems due to limitations and disadvantages present in the conventional art.

An object of the present invention is to provide a method of controlling the drying operation of a washing machine when performing an interim drying operation through a phase control during the drying stroke, and thus reducing the vibration generated in the beginning of the interim drying operation.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, the method of controlling the drying operation of laundry using a motor includes: an initial drying step for proceeding with the initial drying operation by applying a power voltage to a motor for a predetermined period of time according to the volume of laundry being treated; an interim drying step for proceeding with an interim drying operation by applying a power voltage with a predetermined phase angle to the motor according to the volume of the laundry; and a main drying step for proceeding with the main drying operation by applying a power voltage to the motor for a predetermined period of time.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the drawings, wherein.

DETAILED DESCRIPTION OF PREFERRED EMBODIMENT

Reference will now be made in detail to the preferred embodiments of the present invention, examples of which are illustrated in the accompanying drawings.

Figure 1:
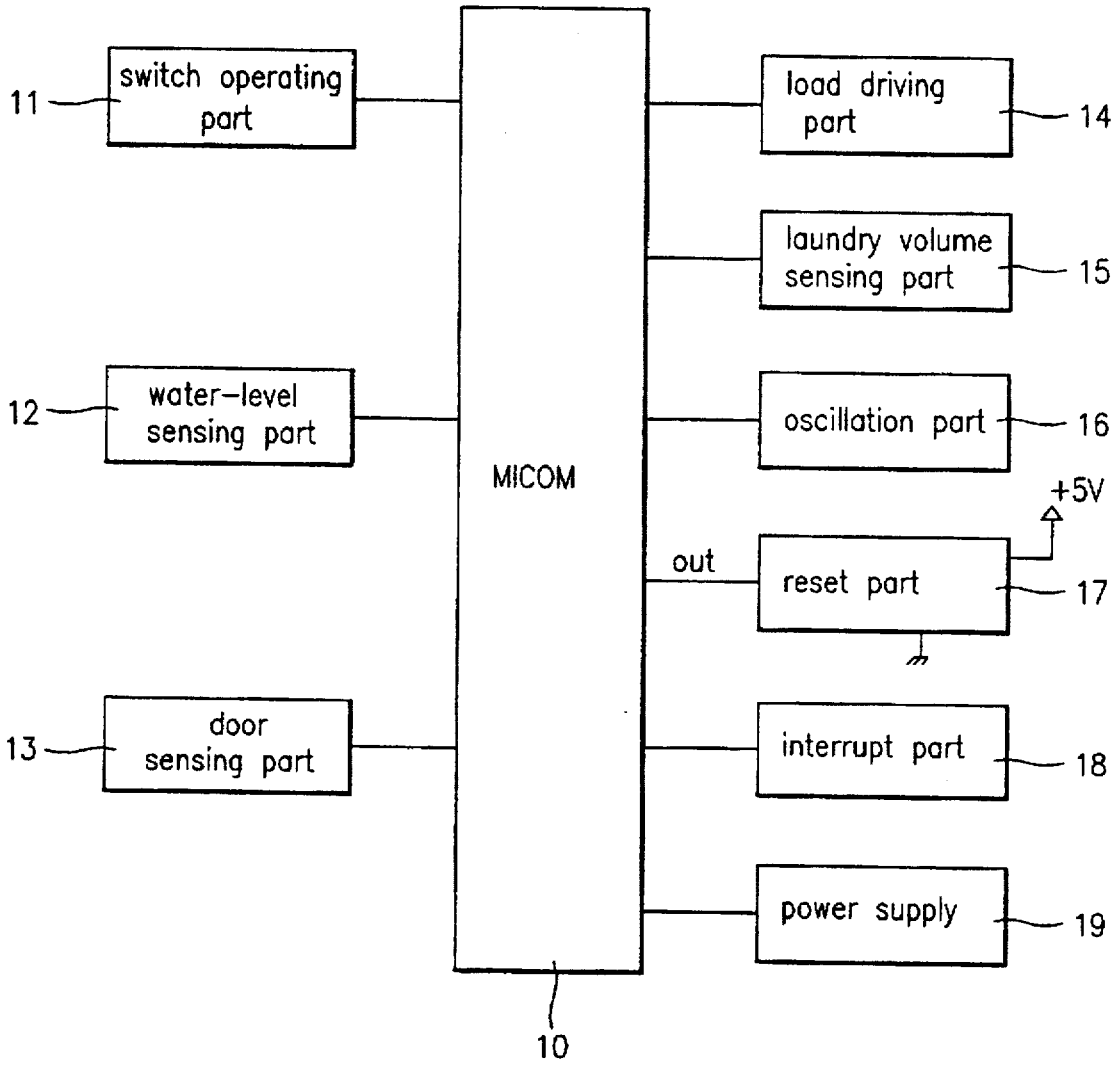
FIG.1 conventional art
FIG. 1 is a block diagram of a general washing machine.
Figure 2:
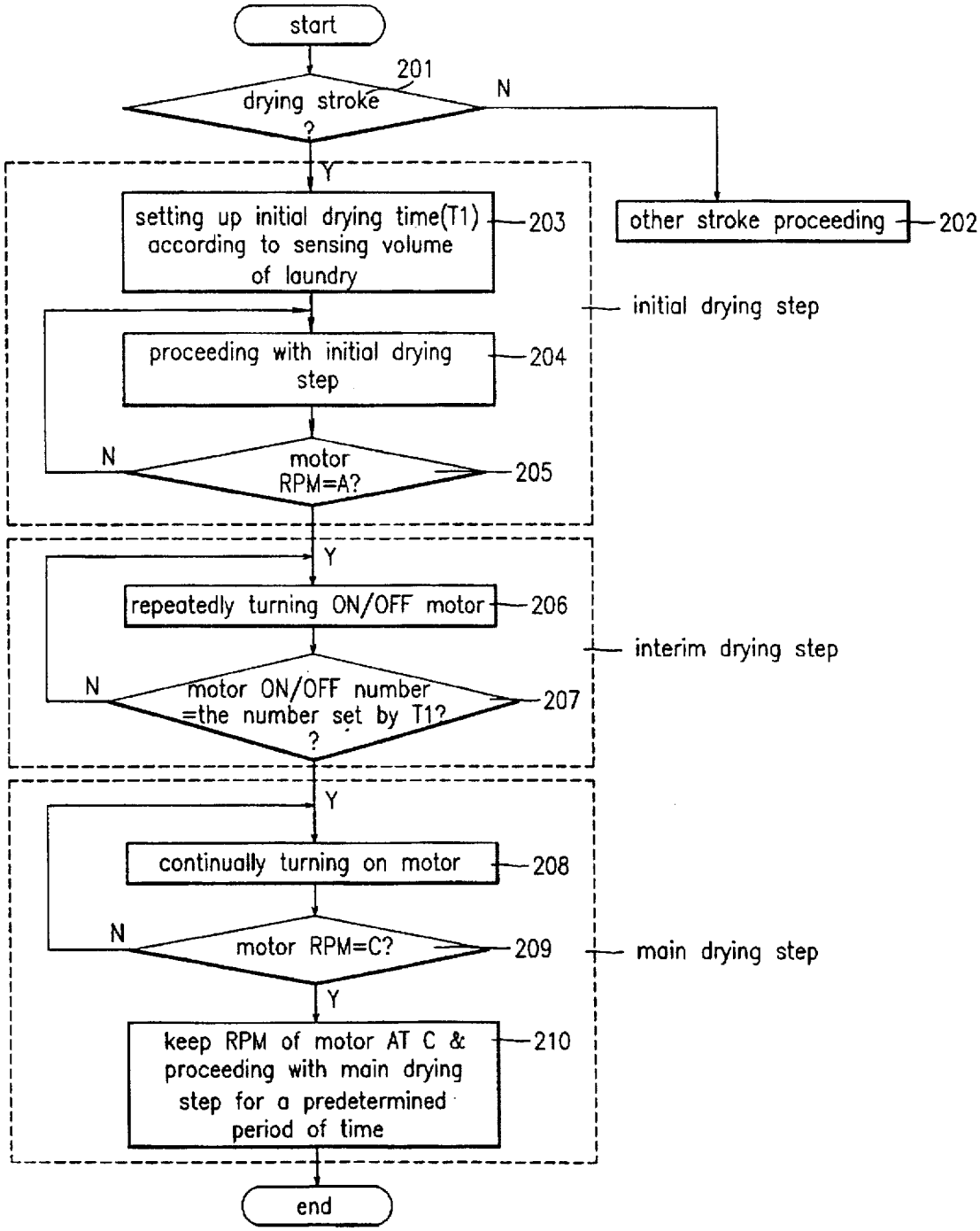
FIG.2 prior art
FIG. 2 is a flowchart illustrating a conventional method of controlling the drying operation of the washing machine.
Figure 3:
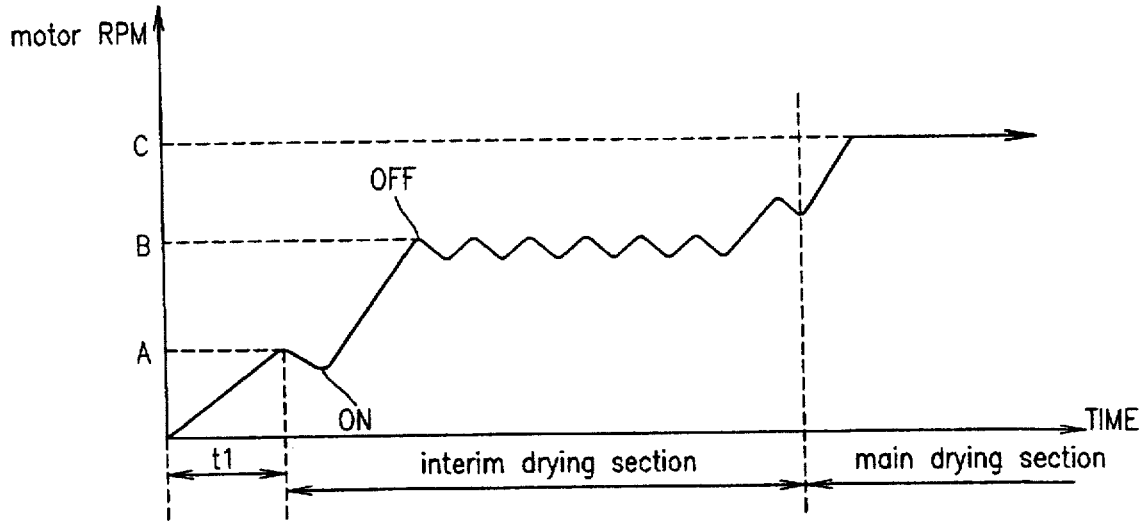
FIG.3 prior art
FIG. 3 is a graph illustrating a drying operation control of FIG. 2 as a function of the RPM of the motor.
Figure 4:
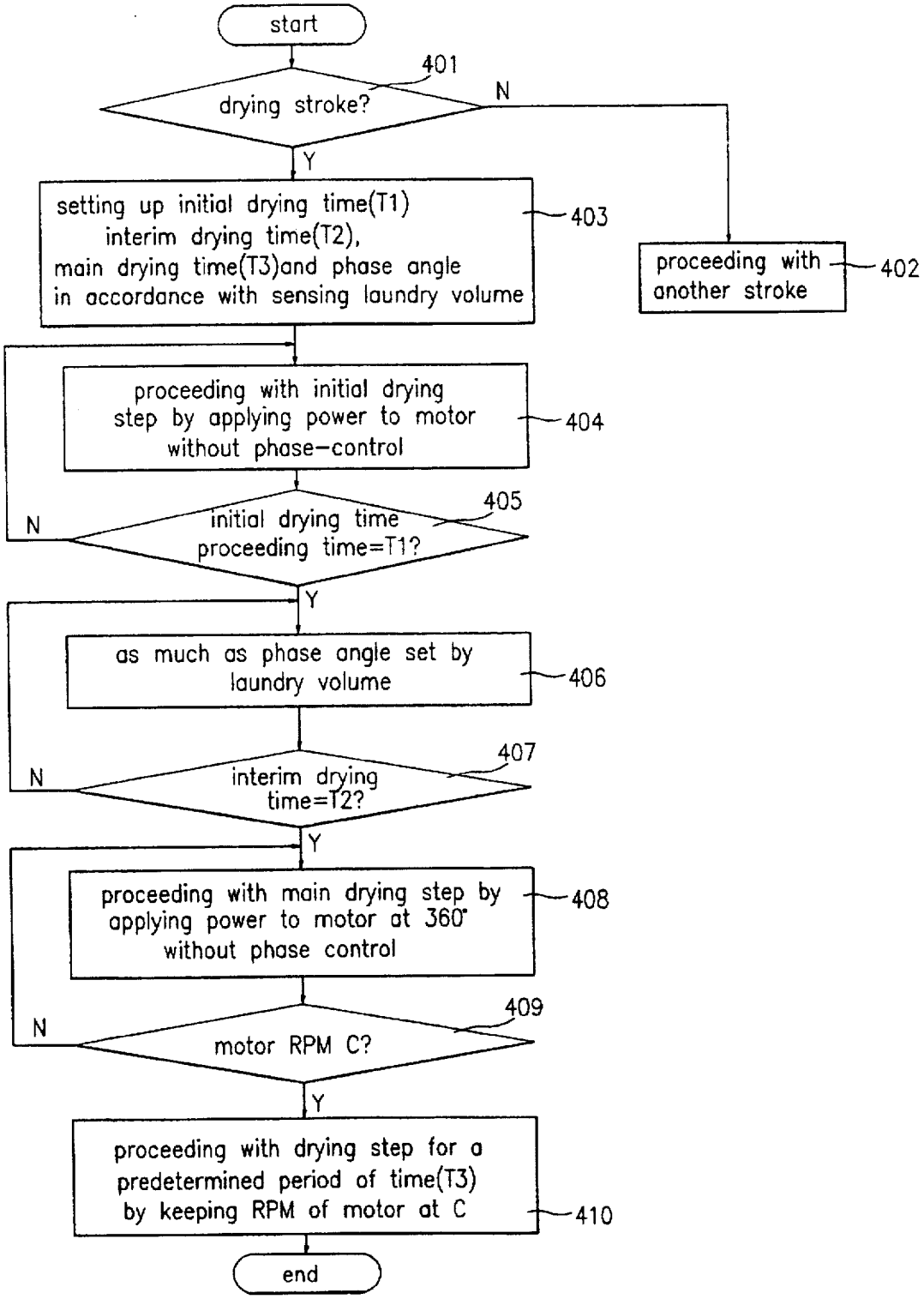
FIG. 4 is a flowchart illustrating the drying operation of a washing machine according to the present invention.

FIG. 4 is a flowchart illustrating the drying operation of a washing machine of the present invention, namely in the case where there is no means for sensing the revolution speed (RPM) of the motor.

After the water is drained, it is determined whether the stroke is for drying in step 401. If not, another stroke can be performed in step 402. If the operation is for controlling the drying stroke, the drying time is divided into an initial drying time t1, an interim drying time t2, and main drying time t3, according to a multi-level laundry volume sensed by the laundry volume sensing part 15. The phase angles are fixed in step 403 in response to the time.

The initial drying operation is performed by applying 100% power voltage to the motor at 360° without a phase control for the fixed initial drying time t1 according to the laundry volume of the above step 403, in step 404.

When the initial drying operation is performed, in step 405, and for the initial drying time t1 fixed in S403, power is applied to the motor for the phase angle fixed in the above step 403 to perform the interim drying operation for the interim drying time t2 in step 406. Here, the phase angle may be fixed into three levels: A, B, C as in FIG. 5, while the number of phase angles may depend on the particular program.

In this embodiment of the present invention, A, B and C are fixed as illustrated in FIG. 5.

Figures 5A, 5B:
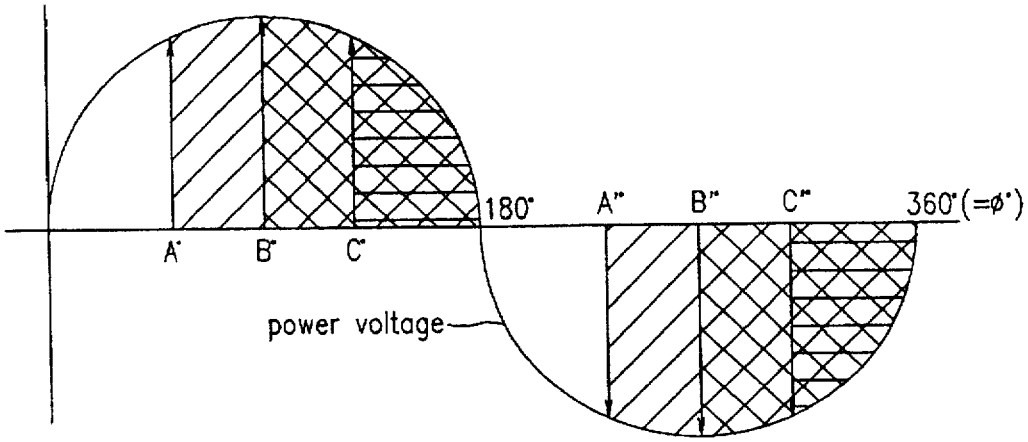
FIG. 5A is a waveform illustrating the motor's phase control according to the present invention.
FIG. 5B is a table illustrating the phase angle control according to the volume of laundry being treated.

If the laundry volume sensed by the laundry volume sensing part 15 is A>B>C, as illustrated in FIG. 5B, the phase controlling angle in case of A becomes A°, A'°; the phase controlling angle in case of B becomes B°, B'°, and the phase controlling angle in case of C becomes C°, C"°.

For example, if the laundry volume sensed by the laundry volume sensing part 15 is assumed to be A, the motor is turned on at A° through 180°, turned off at 180° through A'°, turned on at A'° through 360°, and turned off at 360° (0)° through A°.

If the laundry volume sensed by the laundry volume part 15 is assumed to be B, the motor is turned on at B° through 180°, turned off at 180° through B'°, turned on at B'° through 360°, and turned off at 360° (0)° through B°. The principle here is that the voltage becomes higher as the phase angle is greater, and vice versa.

As described above, if power is continually applied to the motor at the phase angle fixed according to the volume of laundry for the interim drying time t2, the water contained in the laundry is drained, and the motor is also accelerated slowly to increase the RPM of the motor in step 407. Here, the interim drying operation controls the phase angle, so that the motor revolves when the power is turned off by the inertia, revolutional force.

Figure 6:
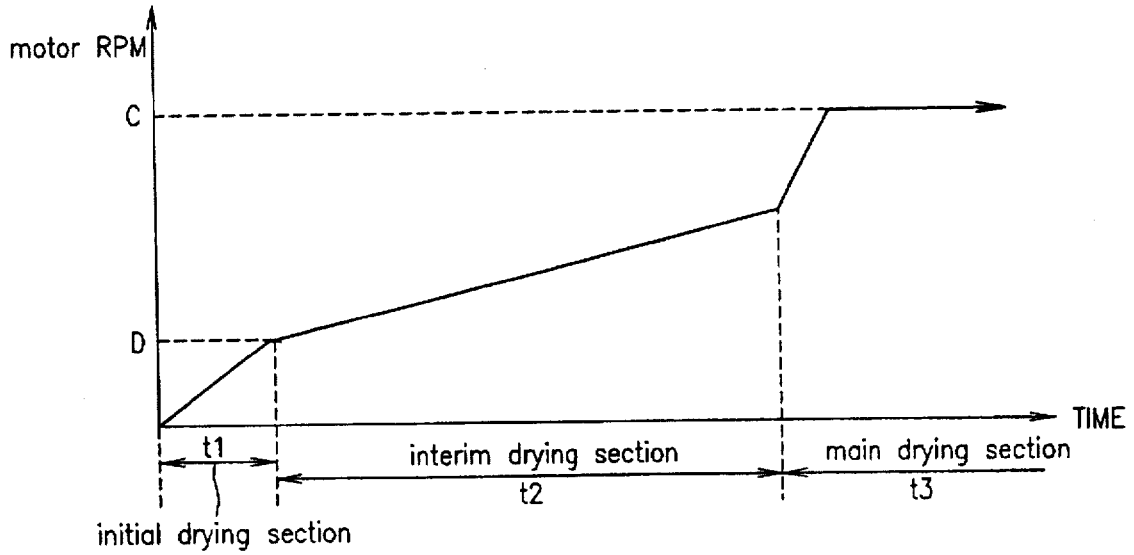
FIG. 6 is a graph illustrating the drying operation control of FIG. 4 as a function of the RPM of the motor.

When the interim drying operation is performed for the interim drying time t2, 100% power is applied to the motor at 360° without its phase control in step 408. When the RPM of the motor reaches C as illustrated in FIG. 6 in step 409, the motor is continually applied to the motor to maintain the RPM of the motor at C, and proceeds with the main drying operation for the predetermined period of time t3 in step 410.

When there is a revolution speed sensing means associated with the motor, the time during which the motor reaches a predetermined RPM can be recognized. Therefore, the power voltage is applied to the motor in 360° without the phase control of power until the RPM of the motor reaches D as illustrated in FIG. 6 after starting the drying operation, in order to proceed with the initial drying operation.

Here, the RPM C and RPM D of the motor are the RPMs of respective drying sections varied in accordance with the laundry volume sensed by the laundry volume sensing part 15. D is the RPM of the motor for the initial drying operation. C is the RPM of the motor for the main drying operation and thus determined by a test.

As described above, the drying operation controlling method of the washing machine according to the present invention proceeds with the interim drying operation by applying power only as much as the phase angle which is fixed according to the volume of the laundry. Therefore, the invention reduces the washing tub's vibration generated in the beginning of the interim drying operation because the RPM is gradually increased without stopping of the motor, and also prolongs the life of the clutch.

It will be apparent to those skilled in the art that various modifications and variations can be made in the drying operation controlling method for the washing machine of the present invention without departing from the spirit or scope of the invention. Thus, it is intended that the present invention cover the modifications and variations of this invention provided they come within the scope of the appended claims and their equivalents.

What is claimed is:

1. A method of controlling the drying operation of a washing machine which comprises:

proceeding with an initial drying operation by applying a power voltage to a motor for a predetermined period of time according to the volume of laundry being treated;

proceeding with an interim drying operation by applying a power voltage to said motor at a predetermined phase angle according to the volume of the laundry; and following with a main drying operation by applying a power voltage to said motor for a predetermined period of time.

2. The method as claimed in claim 1, wherein said initial drying operation is performed until the revolution per minute of the motor reaches a predetermined RPM after the power voltage of 100% is applied to said motor.

3. The method as claimed in claim 1, wherein said interim drying operation comprises the steps of:

dividing the volume of the laundry into multiple levels; and applying the power voltage to the predetermined phase angle corresponding to said multiple levels.

4. The method as claimed in claim 1, wherein said main drying operation comprises the steps of:

applying a power voltage of 100% to said motor until said motor reaches a predetermined RPM; and maintaining the predetermined RPM of said motor to fully perform said drying operation.

* * * * *